US010806236B2

(12) United States Patent
Kies

(10) Patent No.: US 10,806,236 B2
(45) Date of Patent: Oct. 20, 2020

(54) CARRYING CASE

(71) Applicant: Daniel Kies, Santa Maria, CA (US)

(72) Inventor: Daniel Kies, Santa Maria, CA (US)

( * ) Notice: Subject to any disclaimer, the term of this patent is extended or adjusted under 35 U.S.C. 154(b) by 0 days.

(21) Appl. No.: 16/506,317

(22) Filed: Jul. 9, 2019

(65) Prior Publication Data

US 2020/0268130 A1 Aug. 27, 2020

Related U.S. Application Data

(60) Provisional application No. 62/850,588, filed on May 21, 2019, provisional application No. 62/809,775, filed on Feb. 25, 2019.

(51) Int. Cl.

| | |
|---|---|
| ***A45F 3/00*** | (2006.01) |
| ***A45F 3/02*** | (2006.01) |
| *E04H 15/32* | (2006.01) |
| *A47C 7/62* | (2006.01) |

(52) U.S. Cl.

CPC ..... *A45F 3/02* (2013.01); *A45F 2003/003* (2013.01); *A47C 7/622* (2018.08); *E04H 15/32* (2013.01)

(58) Field of Classification Search

CPC ..... A45F 3/02; A45F 2003/003; A47C 7/622; E04H 15/32

USPC ..... 224/607

See application file for complete search history.

(56) References Cited

U.S. PATENT DOCUMENTS

| | | | | |
|---|---|---|---|---|
| 2,925,111 | A | 2/1960 | Satterfield | |
| 4,979,833 | A | 12/1990 | Cook | |
| 5,096,104 | A | 3/1992 | Wirth | |
| 5,118,201 | A | 6/1992 | Cook | |
| 5,160,196 | A | 11/1992 | Curtis | |
| 5,433,502 | A | 7/1995 | Condorodis et al. | |
| 5,435,025 | A * | 7/1995 | Gerard | A45C 3/10 5/417 |
| 6,182,309 | B1 * | 2/2001 | Sullivan | A45C 3/10 5/419 |
| 6,808,081 | B1 | 10/2004 | Citro | |
| 7,007,991 | B1 | 3/2006 | Sapp | |
| 7,748,556 | B2 | 7/2010 | Yang et al. | |
| 8,127,956 | B2 | 3/2012 | Krotts et al. | |
| D702,942 | S | 4/2014 | Redman | |
| 10,029,849 | B1 | 7/2018 | Genotti | |
| 2004/0124195 | A1 | 7/2004 | Mensch | |
| 2004/0131801 | A1 | 7/2004 | Wong | |
| 2005/0140103 | A1 | 6/2005 | Marchant et al. | |
| 2008/0044111 | A1 | 2/2008 | Faraone | |

(Continued)

*Primary Examiner* — Peter N Helvey

(74) *Attorney, Agent, or Firm* — Argus Intellectual Enterprise; Daniel Enea; Jordan Sworen

(57) ABSTRACT

A carrying case for storing folding chairs, tents, and outdoor equipment. The carrying case includes a sidewall between a first end having an opening and a closed second end forming an interior volume. A collar is positioned at the first end and includes a channel that is coaxially aligned with the opening of the first end such that the equipment enters the interior volume through the channel of the collar and the opening. The collar further comprises a distal end having a first diameter that tapers to a smaller second diameter at a proximal end. In a foot recess embodiment, a foot recess forms a compartment on the sidewall that is adapted to receive a foot or toe of a user. In a foot flange embodiment, the carrying case includes a flange that extends about the second end that is adapted to receive a foot or toe of a user.

20 Claims, 7 Drawing Sheets

(56) References Cited

U.S. PATENT DOCUMENTS

| | | | | |
|---|---|---|---|---|
| 2010/0066131 | A1* | 3/2010 | Smith | A47O 4/286<br>297/16.1 |
| 2014/0144963 | A1 | 5/2014 | Moore et al. | |

* cited by examiner

CARRYING CASE

CROSS REFERENCE TO RELATED APPLICATION

This application claims the benefit of U.S. provisional application No. 62/850,588 filed on May 21, 2019, and U.S. provisional application No. 62/809,775 filed on Feb. 25, 2019; the above identified patent applications are herein incorporated by reference in its entirety.

BACKGROUND OF THE INVENTION

The present invention relates to a carrying case. More specifically, the present invention relates to a carrying case having a collar that assists with the insertion of a collapsible or folding chair, tent, or other collapsible equipment.

Personal collapsible chairs are extremely popular and common and can be found at virtually every outdoor event. Many of these collapsible chairs are carried by storage bags of some kind and many examples of such devices can be found in the prior art. The problem, however, is that due to the irregular shape and configuration of these collapsible chairs in their folded states, loading and unloading them into and from their respective carriers can be very difficult. The same situation applies to folding tents and other equipment as well.

There have been attempts to solve this problem, however none of the known devices provide a collar having a taper that assists with the insertion of folding chairs therein. For example, one known device provides a carrying case having a drawstring at the open top to secure the chair within. However, this device fails to provide any structural element that eases the user's ability to load the chair through the open top. Another inconvenience is that existing devices fail to provide a foot recess or foot flange in a convenient location so the user may apply pressure to the carrying case and thereby further assist with the insertion and removal of the equipment from the carrying case.

In view of the above concerns, it is desirable to provide an embodiment of the carrying case that includes a sidewall comprising flexible material that is configured to be movable between an extended position in use and a collapsed position for storing. Particularly, it is desirable to provide the carrying case having a rigid collar and flexible sidewall for the dual purpose of assisting with the insertion and loading of a folding chair and compactly storing the device when not in use.

In light of the devices disclosed in the known art, it is submitted that the present invention substantially diverges in design elements and methods from the known art and consequently it is clear that there is a need in the art for an improvement for a carrying case. In this regard the instant invention substantially fulfills these needs.

SUMMARY OF THE INVENTION

In view of the foregoing disadvantages inherent in the known types of carrying cases now present in the known art, the present invention provides a new carrying case wherein the same can be utilized for storing folded or collapsed chairs, tents, and other outdoor equipment therein.

It is an objective of the present invention to provide a carrying case having a sidewall, a first end having an opening, and a closed second end forming an interior volume. The opening provides access to the interior volume which is sized to house equipment in a folded configuration.

A collar is affixed to the first end, wherein the collar comprises a channel coaxially aligned with the opening of the first end such that the equipment enters the interior volume through the channel of the collar and the opening. The collar further comprises a distal end having a first diameter that tapers to a smaller second diameter at a proximal end.

In a foot recess embodiment, a foot recess is disposed on the sidewall, wherein the foot recess forms a compartment dimensioned to receive a foot or toe of a user.

In a foot flange embodiment, the carrying case further comprises a flange extending about the second end. The flange is configured to provide stability to the carrying case when loading and unloading from an upright position.

It is therefore an object of the present invention to provide a new and improved carrying case that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
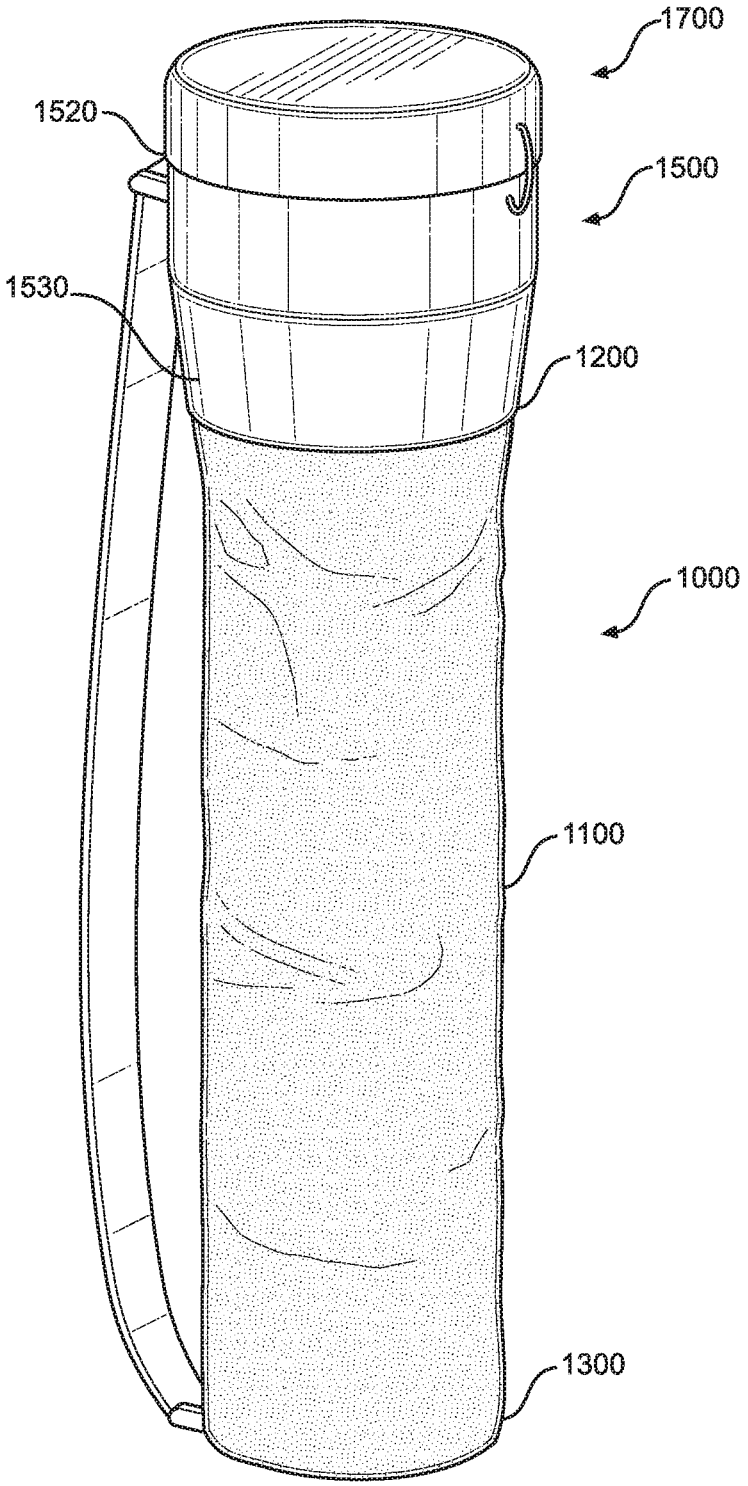
FIG. 1A shows a perspective view of a first embodiment of the carrying case in an expanded configuration.

Reference is made herein to the attached drawings. Like reference numerals are used throughout the drawings to depict like or similar elements of the carrying case. For the purposes of presenting a brief and clear description of the present invention, the preferred embodiment will be discussed as used for a collapsed folding chair therein. The figures are intended for representative purposes only and should not be considered to be limiting in any respect.

Figure 1B:
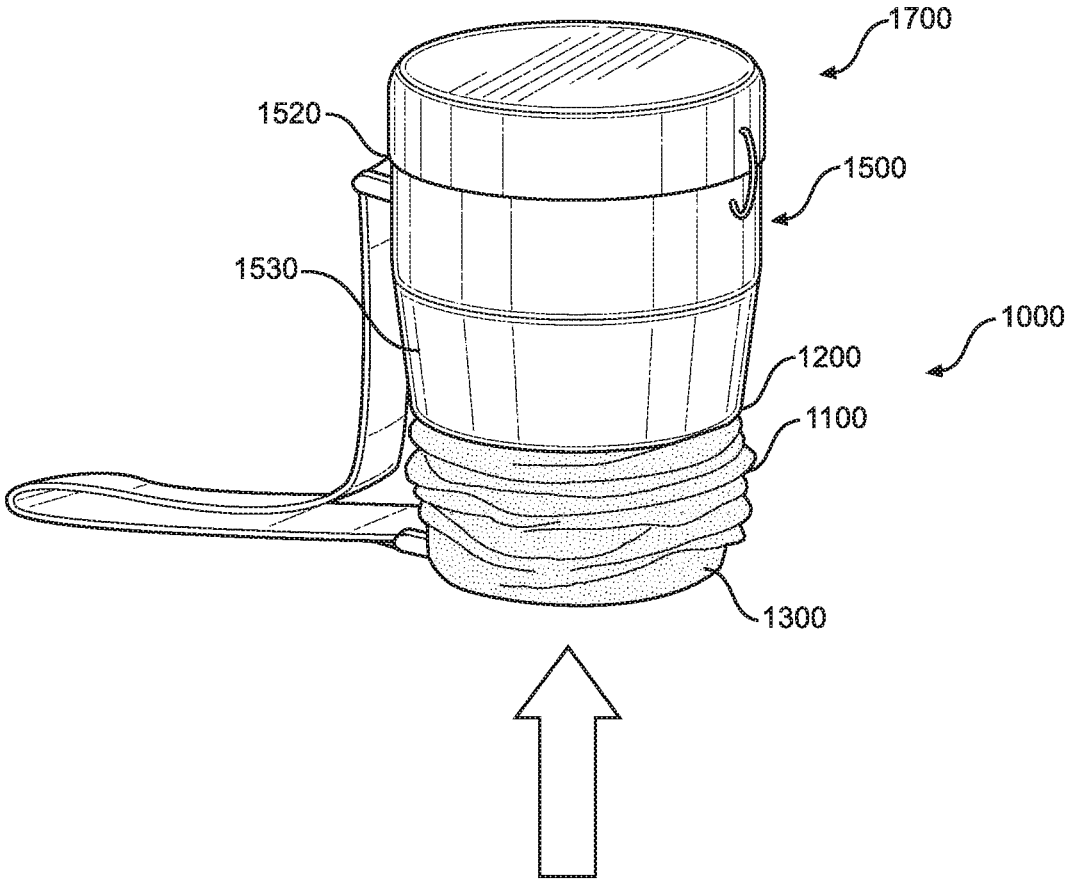
FIG. 1B shows a perspective view of the first embodiment of the carrying case in a collapsed configuration.
Figure 3:
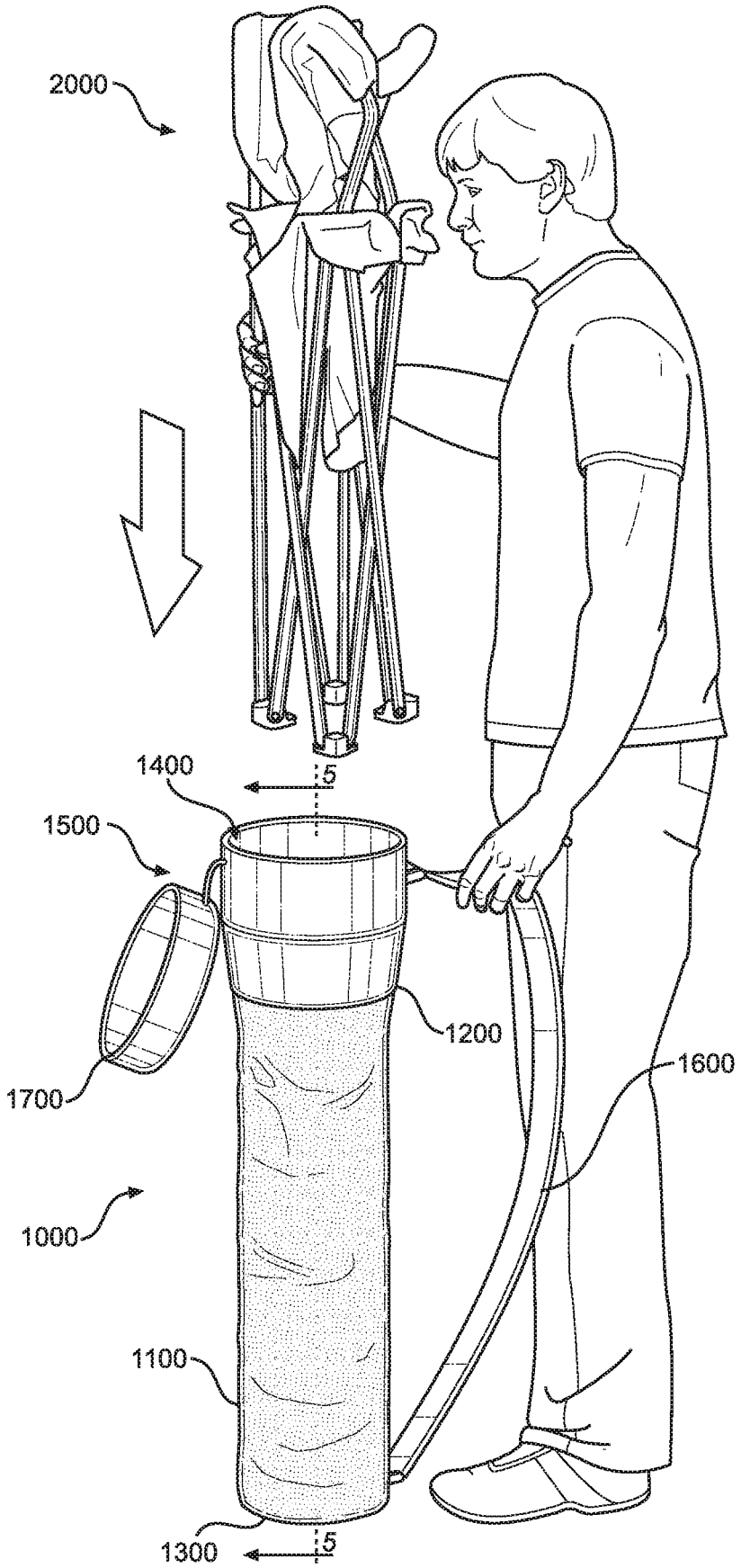
FIG. 3 shows a perspective view of the first embodiment of the carrying case being loaded with a collapsed folding chair.

Referring now to FIGS. 1A and 1B, there is shown a perspective view of a first embodiment of the carrying case in an expanded configuration and a perspective view of a first embodiment of the carrying case in a collapsed configuration, respectively. The carrying case 1000 provides a container configured to house irregular shaped equipment, such as folding chairs, tents, and other equipment and assists with the insertion of the equipment within the carrying case 1000 via a collar 1500. In the shown embodiment, the carrying case 1000 is a container that comprises a sidewall 1100, a first end 1200 having an opening, and a closed second end 1300 forming an interior volume. The carrying case 1000, as shown, generally forms a tube structure with rounded edges, wherein the opening 1250 (as shown in FIG. 3), provides access to the interior volume of the carrying case 1000. In alternative embodiments, the dimension of the carrying case 1000 may have a cubical shape, an elliptical shape, and the like. The interior volume is unobstructed and dimensioned to house the equipment in a folded configuration therein.

In the shown embodiment, a collar 1500 is affixed to the first end 1200 of the carrying case 1000, wherein the collar 1500 is adapted to facilitate the insertion of the equipment into the carrying case 1000. In the shown embodiment, the collar 1500 comprises a channel coaxially aligned with the opening of the first end 1200 such that the equipment enters the interior volume through the channel of the collar 1500 and the opening. The collar 1500 comprises a distal end 1520 and a proximate end 1530, wherein the distal end 1520 is disposed towards at a furthermost from a center of the carrying case 1000 relative to the proximal end 1530, and the proximal end 1530 is disposed towards the center of the carrying case 1000 relative to the distal end 1520. In the shown embodiment, the collar 1500 is a rigid member that is adapted to bear against a folding chair or other equipment when being inserted into the carrying case without significant deformation. In one embodiment, the collar 1500 is a flexible, fabric, or otherwise deformable member that is affixed with the sidewall 1100, wherein the sidewall 1100 may be a rigid or flexible, fabric, or otherwise deformable member.

In the shown embodiment, the sidewall 1100 comprises a flexible material that is configured to be movable between an extended position (as shown in FIG. 1A) and a collapsed position (as shown in FIG. 1B). As such, the sidewall 1100 in the extended position is adapted to adjust shape to conform to the equipment being housed therein, and the sidewall 1100 in the collapsed position is adapted to fold onto itself so as to occupy a lesser total volume, ideal for compact storage when not in use. In one embodiment, the sidewall 1100 is comprised of nylon. In alternative embodiments, the sidewall is comprised of canvas, polyester, other fabrics, and the like. In some embodiments, the sidewall 1100 is configured to collapse and store entirely within the collar 1500. In the shown embodiment, the sidewall 1100 in the collapsed position comprises a length of one-sixteenth to one eighth the size of the length thereof when in the extended position.

In the shown embodiment, a lid 1700 is removably secured to the distal end 1520 of the collar 1500. The lid 1700 is configured to prevent the contents within the carrying case, such as the equipment, from exiting during transport. In the shown embodiment, the lid 1700 is affixed to the carrying case 1000 via a strap extending from an exterior side of the collar 1500. The lid 1700 is an annular member having a brim extending around an outer perimeter such that the lid 1700 frictionally engages the distal end 1520 of the collar to secure therewith. In alternative embodiments, the lid 1700 is not secured to the carrying case via a strap. In yet another embodiment, the lid 1700 is removably coupled with the carrying case 1000 via a fastener, such as hook and loop fasteners, a threaded connection, and the like. In alternate embodiments, the lid 1700 comprises any suitable cross-sectional shape configured to correspond to the cross-sectional shape of the distal end of the collar to form a closure therewith.

Figure 2A:
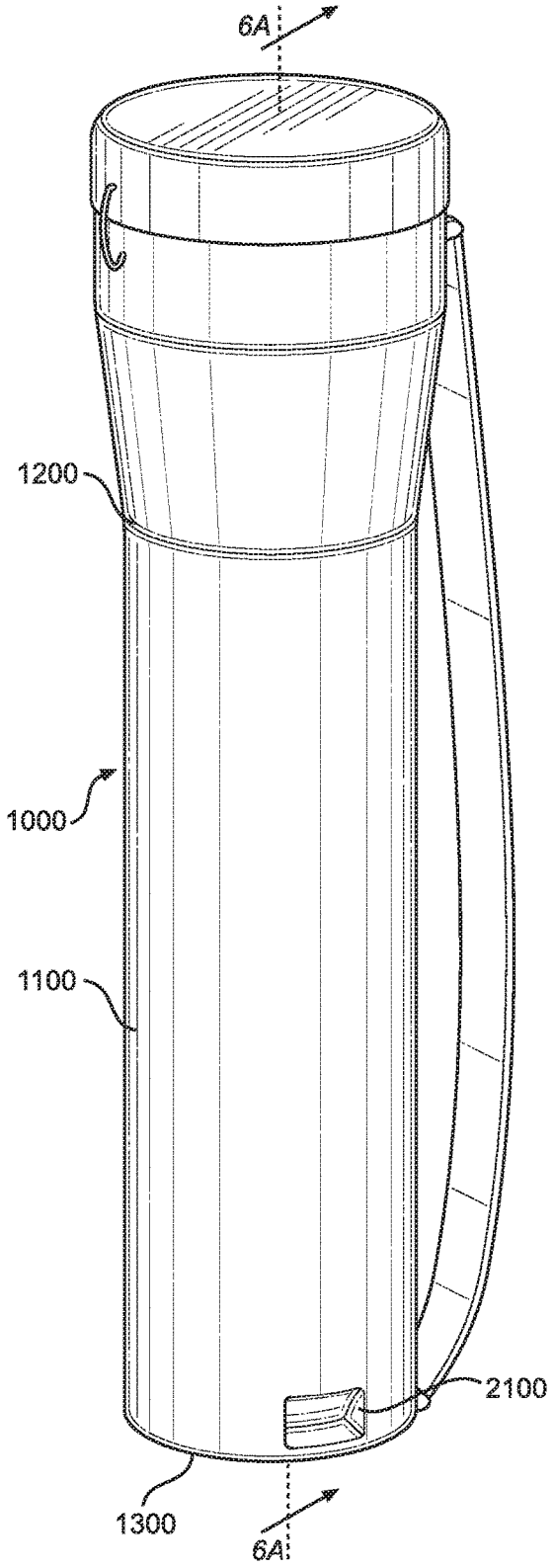
FIG. 2A shows a perspective view of a foot recess embodiment of the carrying case.
Figure 2B:
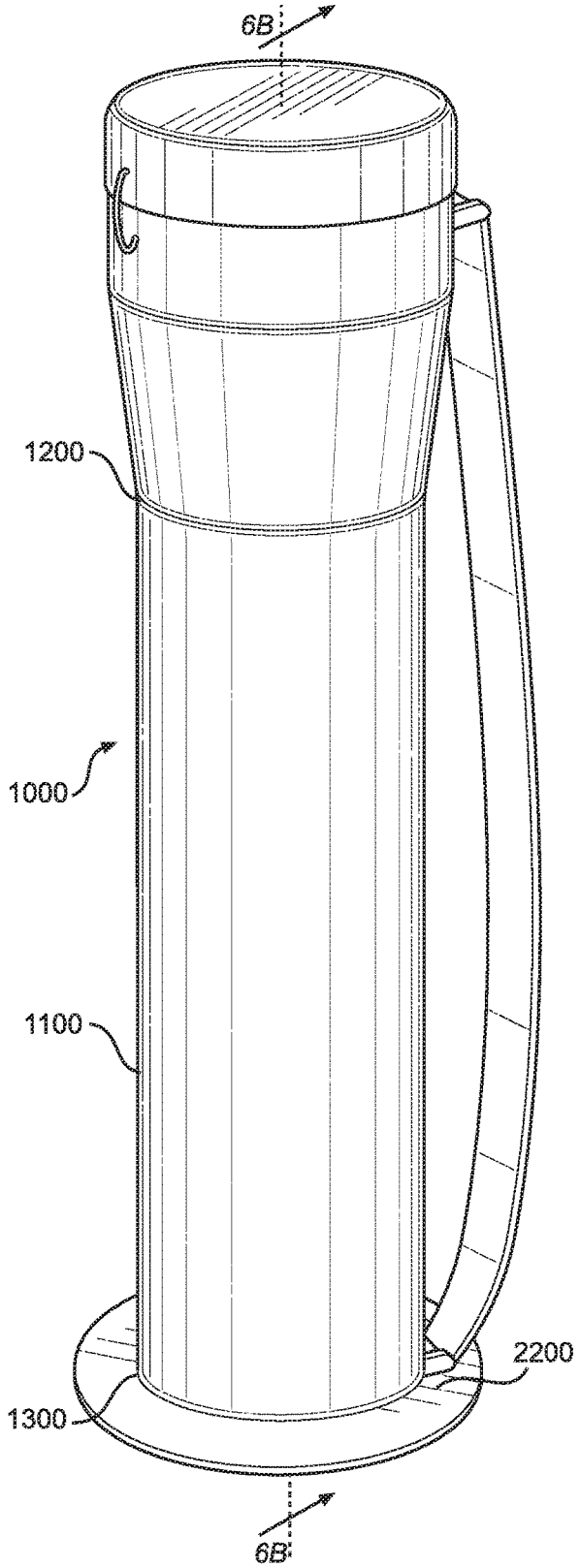
FIG. 2B shows a perspective view of a foot flange embodiment of the carrying case.

Referring now to FIGS. 2A and 2B, there is shown a perspective view of a foot recess embodiment of the carrying case and a perspective view of a foot flange embodiment of the carrying case, respectively. In the foot recess embodiment, the carrying case 1000 comprises a sidewall 1100, a first end 1200 having an opening, and a closed second end 1300 forming an interior volume. In the shown embodiment, the sidewall 1100 comprises rigid or semi-rigid material configured to provide structural integrity and to allow the carrying case 1000 to maintain an upright position seated on a surface. In an alternative embodiment, the sidewall 1100 comprises a flexible material that is configured to be movable between an extended position and a collapsed position (as shown in FIGS. 1A and 1B).

As shown in FIG. 2A, the foot recess 2100 is disposed on the second end 1300 of the carrying case 1000. The foot recess 2100 forms a compartment dimensioned and configured to receive a toe and/or foot of a user therein. In the illustrated embodiment, the recess 2100 comprises a semi-circular shape adapted to conform to the shape of the foot of a user. However, in alternate embodiments, the recess comprises any suitable shape.

In the foot flange embodiment, the carrying case 1000 comprises a flange 2200, as opposed to a foot recess, in order to assist a user when loading and unloading an object within the interior volume thereof (as shown in FIG. 2B). The flange 2200 is disposed on the second end 1300 of the carrying case 1000. In one embodiment, the flange 2200 extends entirely around a lowermost perimeter of the second end 1300 of the carrying case.

Referring now to FIG. 3, there is shown a perspective view of the first embodiment of the carrying case being loaded with a collapsed folding chair. In one exemplary use, the carrying case 1000 is positioned such that the second end 1300 rests on a ground surface. In the shown embodiment, the sidewall 1100 comprises a flexible fabric in an extended position. The user supports the carrying case in this upright position by handling the strap 1600. With a free hand, the user guides the equipment into the interior volume 1400 of the carrying case 1000. The collar 1500 provides guidance of the equipment into the interior volume 1400 regardless if the insertion angle is not aligned with the opening at first end 1200. In this way, the tapered shape of the collar 1500 contacts and abuts the equipment 2000 being inserted so as to realign the equipment 2000 as needed with the first end 1200. As the equipment 2000 bears against the collar 1500, the tendency to cause the carrying case to fall over is negated by the handling of the strap 1600 by the user. Once the equipment has been loaded within the carrying case 1000, the lid 1700 is secured to the distal end of the collar 1500. The strap 1600 further provides for carrying of the carrying case 1000.

In one embodiment, the collar 1500 comprises a length measured as the distance between the distal end and proximate end. The sidewall 1100 comprises a length measured as the distance between the first and second end thereof. In the illustrated embodiment, the length of the collar is approximately one-third the length of the sidewall 1100. In alternate embodiments, the collar comprises a length between one-quarter to one-half of the length of the sidewall.

Figure 4A:
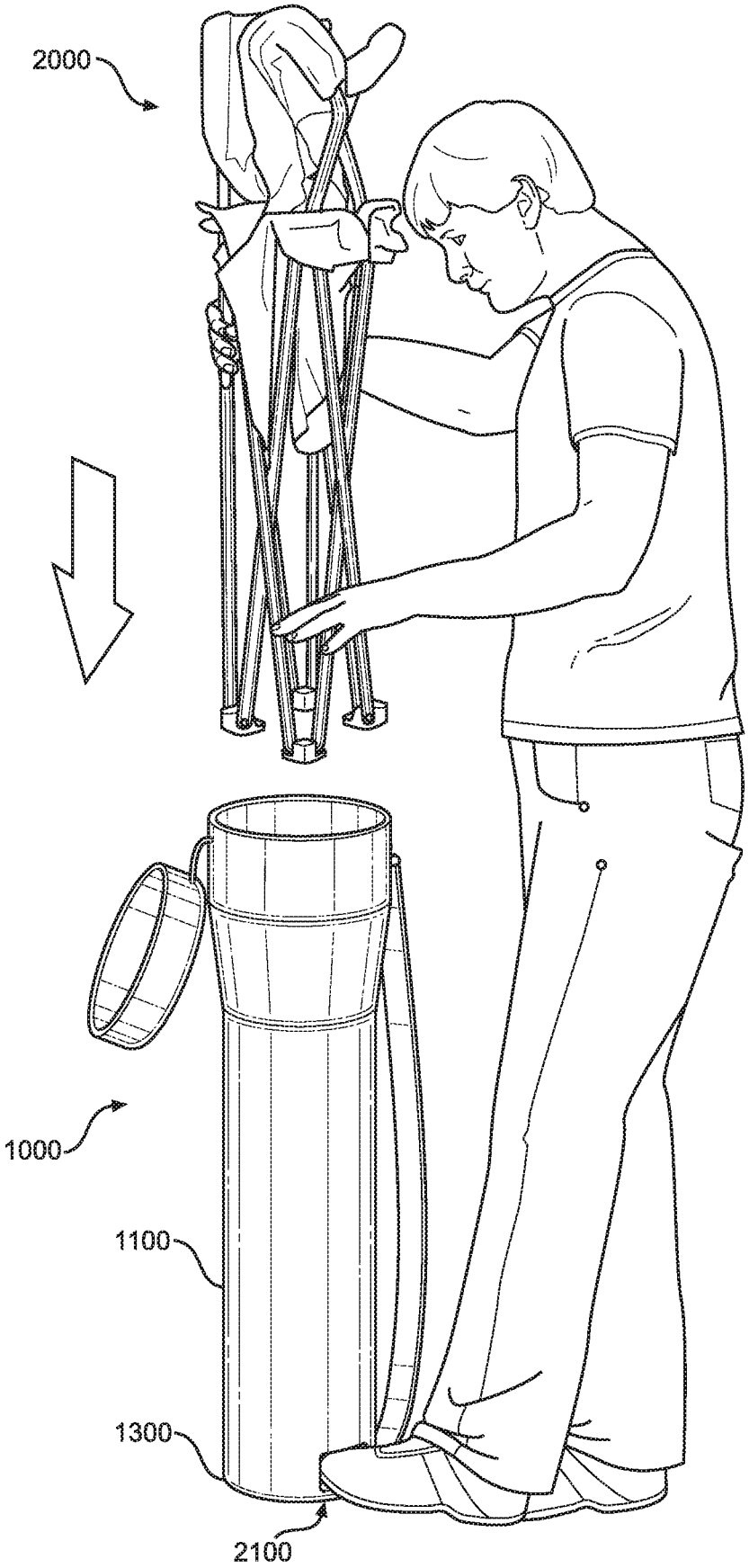
FIG. 4A shows a perspective view of the foot recess embodiment of the carrying case being loaded with a collapsed folding chair.
Figure 4B:
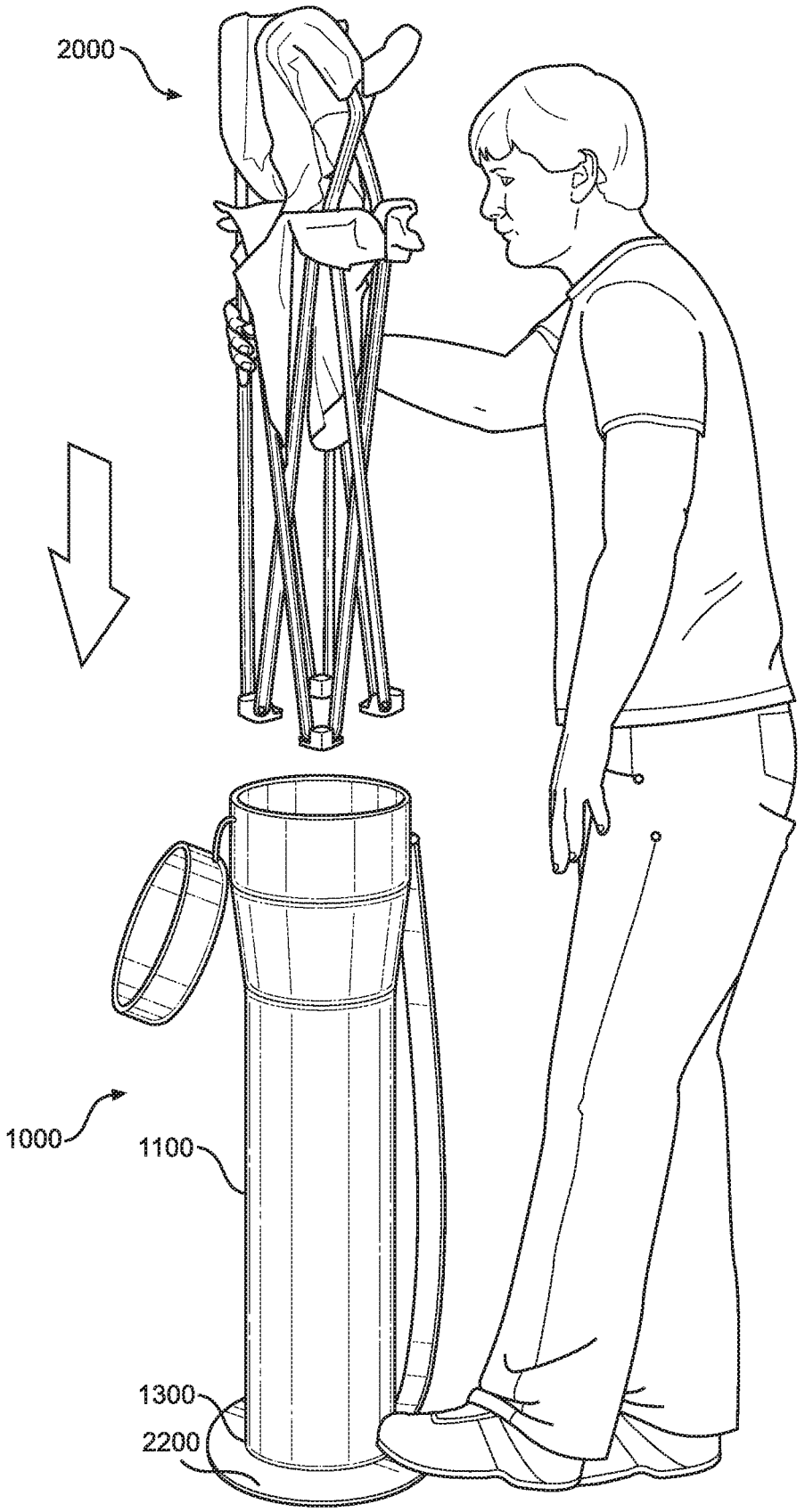
FIG. 4B shows a perspective view of the foot flange embodiment of the carrying case being loaded with a collapsed folding chair.

Referring now to FIGS. 4A and 4B, there is shown a perspective view of the foot recess embodiment and a foot flange embodiment of the carrying case being loaded with a collapsed folding chair, respectively. In one exemplary use of the foot recess embodiment shown in FIG. 4A, the carrying case 1000 is resting on a ground surface at the closed second end 1300 in an upright position, and the user steps into the foot recess 2100, thereby pinning a lower surface of the carrying case 1000 to the ground surface. In one exemplary use of the foot flange embodiment shown in FIG. 4B, the user steps into the foot recess 2200, thereby pinning the flange 2200 of the carrying case 1000 to the ground surface.

In the shown embodiments, the sidewall 1100 comprises a rigid material that maintains the structural integrity such that securing of the lower surface causes the entire carrying case 1000 to remain secured in the upright position. The user is then free to handle the equipment 2000 to insert and load the equipment into the interior volume of the carrying case 1000. The collar 1500 provides guidance of the equipment 2000 into the interior volume regardless if the insertion angle is not aligned with the opening at first end 1200. In this way, the tapered shape of the collar 1500 contacts and abuts the equipment 2000 being inserted so as to realign the equipment as needed with the first end 1200. As the equipment 2000 bears against the collar 1500, the tendency to cause the carrying case to fall over is negated by the pressure being exerted in the foot recess 2100 and flange 2200, respectively, to maintain the carrying case in the upright position. Once the equipment has been loaded within the carrying case 1000, the lid 1700 is secured to the distal end of the collar 1500. The strap 1600 further provides for carrying of the carrying case 1000.

Figure 5:
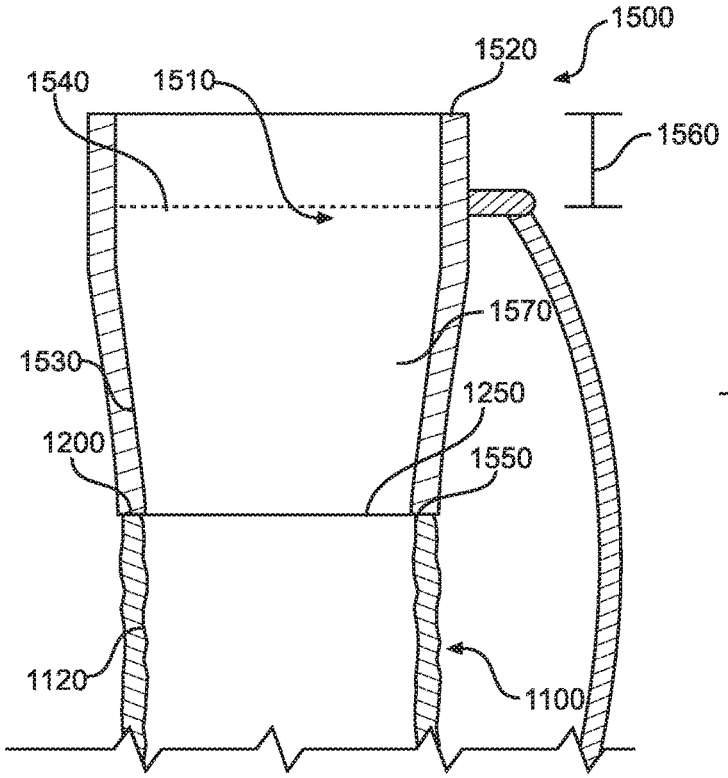
FIG. 5 shows a cross-sectional view of the collar of the first embodiment of the carrying case taken along line 5-5 of FIG. 3.

Referring now to FIG. 5, there is shown a cross-sectional view of the collar of the first embodiment of the carrying case taken along line 5-5 of FIG. 3. The collar 1500 is affixed to the first end 1200, wherein the collar 1500 comprises a channel 1510 coaxially aligned with the opening 1250 of the first end 1200 such that the equipment enters the interior volume 1400 through the channel 1510 and the opening 1250. The distal end 1520 comprises a first diameter 1540 that tapers to a smaller second diameter 1550 at the proximal end 1530. In this way, an inner side of the collar 1500 tapers radially inwards towards a central longitudinal axis of opening 1250. In the shown embodiment, the collar 1500 includes a projection 1560 at the distal end 1520, the projection 1560 having a height wherein the first diameter 1540 is uniform throughout the height.

In the shown embodiment, an inner side 1120 of the sidewall 1100 is either: continuous with an inner surface 1570 of the proximal end 1530 of the collar 1500, or radially offset from the inner surface 1570 of the proximal end 1530 of the collar 1500 whereby the inner side 1120 forms a third diameter larger than the second diameter 1550 at the proximal end 1530 of the collar 1500. In this way, the sidewall 1100 does not form an interior shoulder with the collar 1500 that may inhibit insertion of the equipment into the interior volume of the carrying case. The transition between the inner surface of the collar and the inner side of the sidewall is smooth and void of sharp angles.

Figure 6A:
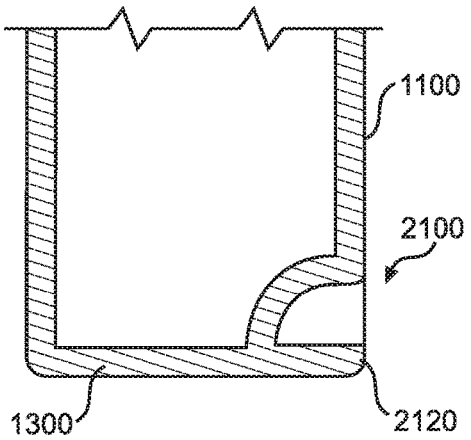
FIG. 6A shows a cross-sectional view of the foot recess of the foot recess embodiment of the carrying case taken along line 6A-6A of FIG. 2A.

Referring now to FIG. 6A, there is shown a cross-sectional view of the foot recess of the foot recess embodiment of the carrying case taken along line 6A-6A of FIG. 2A. In the shown embodiment, the foot recess 2100 is formed by the sidewall 1100 and a lower surface 2120. In the shown embodiment, the lower surface 2120 is at a lowermost point on the second end 1300. However, in alternative embodiments, the foot recess 2100 may be disposed at any point along the sidewall 1100 between the first and second end 1300. Further, the second end 1300 comprises a flat lower side that is adapted to sit flush with a ground surface.

Figure 6B:
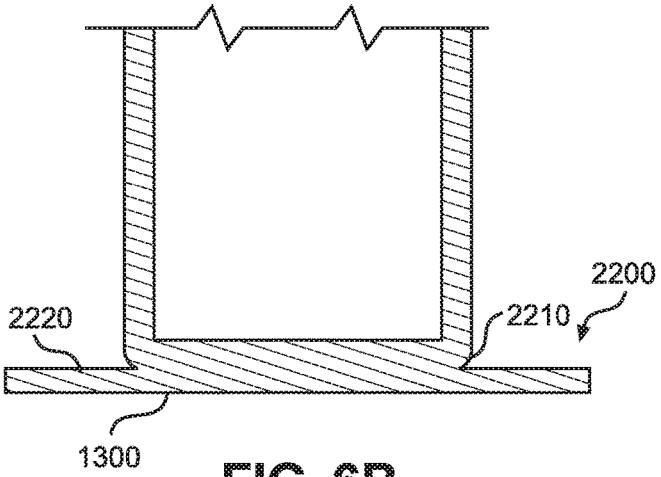
FIG. 6B shows a cross-sectional view of the foot flange of the foot flange embodiment of the carrying case taken along line 6B-6B of FIG. 2B.

Referring now to FIG. 6B, there is shown a cross-sectional view of the foot flange of the foot flange embodiment of the carrying case taken along line 6B-6B of FIG. 2B. In the shown embodiment, the foot flange 2200 extends radially outward and entirely around a lowermost perimeter 2210 of the second end 1300. The flange 2200 forms an upper side 2220 that is configured and dimensioned to receive a toe or foot of the user thereon. In this way, the user may apply pressure onto the flange 2200 and thereby keep the carrying case stationary in use. Further, the second end 1300 comprises a flat lower side that is adapted to sit flush with a ground surface. In one embodiment, the flange 2200 and sidewall 1300 are integral and form a monolithic structure. In an alternative embodiment, the flange 2200 and sidewall 1300 are separable, and removal of the flange 2200 from the sidewall 1300 does not thereby open the second end 1300 of the carrying case 1000.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrying case, comprising:

a sidewall, a first end having an opening, and a closed second end forming an interior volume;

wherein the opening provides access to the interior volume, the interior volume dimensioned to house collapsible equipment in a collapsed configuration;

a collar is affixed to the first end, wherein the collar comprises a channel coaxially aligned with the opening of the first end such that the equipment enters the interior volume through the channel of the collar and the opening;

the collar comprises a distal end and a proximal end, wherein the distal end comprises a first inner diameter that tapers to a smaller second inner diameter at the proximal end;

wherein the closed second end forms a flat lower side that is adapted to sit flush with a ground surface and orient the carrying case generally perpendicular to the ground surface.

2. The carrying case of claim 1, further comprising a strap extending from the first end to the second end configured to transport the carrying case over a shoulder of a user.

3. The carrying case of claim 1, further comprising a lid removably secured to the distal end of the collar, the lid configured to prevent contents within the carrying case from exiting during transport.

4. The carrying case of claim 1, wherein the collar comprises a rigid annular ring.

5. The carrying case of claim 1, wherein the collar comprises a projection at the distal end, the projection having a height wherein the first diameter is uniform throughout the height.

6. The carrying case of claim 1, wherein the collar tapers symmetrically and uniformly between the distal end and the proximal end, wherein the collar is adapted to guide insertion of the collapsible equipment into the interior volume.

7. The carrying case of claim 1, wherein the collar is rigid or semi-rigid and the sidewall is configured to be flexible and collapsible.

8. The carrying case of claim 7, wherein the sidewall is integral to the collar.

9. The carrying case of claim 1, wherein the sidewall comprises rigid or semi-rigid material configured to provide structural integrity and to allow the carrying case to maintain an upright position seated on a surface.

10. The carrying case of claim 1, further comprising a foot recess disposed on the sidewall and is dimensioned to receive a foot or toe of a user.

11. The carrying case of claim 10, wherein the second end of the carrying case is permanently closed and forms a lower surface of the foot recess such that the user presses the second end against a supporting surface for stability when inserting and removing the collapsed equipment therefrom.

12. The carrying case of claim 1, wherein the collar is rigid or semi-rigid and the sidewall is configured to be flexible and collapsible.

13. The carrying case of claim 12, wherein the sidewall is integral to the collar.

14. The carrying case of claim 10, wherein the sidewall comprises rigid or semi-rigid material configured to provide structural integrity and to allow the carrying case to maintain an upright position seated on a surface.

15. The carrying case of claim 1, further comprising a flange extending about the second end, wherein the flange is configured to provide stability to the carrying case when disposed in an upright position.

16. The carrying case of claim 15, wherein the flange extends perpendicularly from a lowermost perimeter of the second end and entirely therearound.

17. The carrying case of claim 1, wherein the collar is rigid or semi-rigid and the sidewall is configured to be flexible and collapsible.

18. The carrying case of claim 17, wherein the sidewall is integral to the collar.

19. The carrying case of claim 15, wherein the sidewall comprises rigid or semi-rigid material configured to provide structural integrity and to allow the carrying case to maintain an upright position seated on a surface.

20. A carrying case, comprising:

a sidewall, a first end having an opening, and a closed second end forming an interior volume;

wherein the opening provides access to the interior volume, the interior volume dimensioned to house collapsible equipment in a collapsed configuration;

a collar is affixed to the first end, wherein the collar comprises a channel coaxially aligned with the opening of the first end such that the equipment enters the interior volume through the channel of the collar and the opening;

the collar comprises a distal end and a proximal end, wherein the distal end comprises a first inner diameter that tapers to a smaller second inner diameter at the proximal end;

wherein the sidewall is configured to be flexible and collapsible, wherein the collar is rigid or semi-rigid and integral to the sidewall;

wherein an inner side of the sidewall is either:

continuous with an inner surface of the proximal end of the collar; or radially offset from the inner surface of the proximal end of the collar whereby the inner sidewall side forms a third inner diameter larger than the second inner diameter at the proximal end of the collar.

* * * * *